US006019041A

United States Patent [19]

Leonhardt et al.

[11] Patent Number: 6,019,041

[45] Date of Patent: Feb. 1, 2000

[54] METHOD OF CONTROLLING THE LEVEL OF PRINTING INK IN AN INK FOUNTAIN AND FOR EMPTYING AN INK CARTRIDGE HAVING LESS THAN A SPECIFIED AMOUNT OF INK THEREIN

[75] Inventors: Holger Leonhardt, Bammental; Wolfgang Luxem, Dossenheim, both of Germany

[73] Assignee: Heidelberger Druckmaschinen AG, Heidelberg, Germany

[21] Appl. No.: 09/268,270

[22] Filed: Mar. 15, 1999

[30] Foreign Application Priority Data

Mar. 14, 1998 [DE] Germany ..... 198 11 159

[51] Int. Cl.[7] ..... B41F 31/02

[52] U.S. Cl. ..... 101/366; 101/365; 101/367

[58] Field of Search ..... 101/350, 351, 101/350.1, 351.1, 352.01, 363–367, 207–210, 356, 148; 118/258, 259; 222/51, 64, 67

[56] References Cited

U.S. PATENT DOCUMENTS

| | | | |
|---|---|---|---|
| 3,848,529 | 11/1974 | Gegenheimer et al. | 101/363 |
| 4,479,433 | 10/1984 | MacPhee et al. | 101/364 |
| 4,709,633 | 12/1987 | Woestman | 101/163 |
| 4,787,313 | 11/1988 | Osborn et al. | 101/366 |
| 5,265,535 | 11/1993 | Isowa et al. | 101/350 |
| 5,724,890 | 3/1998 | Deschner et al. | 101/366 |

FOREIGN PATENT DOCUMENTS

| | | |
|---|---|---|
| 31 09 303 C2 | 9/1989 | Germany . |
| 195 12 727 A1 | 10/1996 | Germany . |
| 196 00 796 A1 | 7/1997 | Germany . |
| 196 367 985 C1 | 1/1998 | Germany . |
| 2 074 240 A | 10/1981 | United Kingdom . |
| 2 299 546 | 10/1996 | United Kingdom . |

*Primary Examiner*—Kimberly L. Asher
*Attorney, Agent, or Firm*—Herbert L. Lerner; Laurence A. Greenberg

[57] ABSTRACT

A method of controlling a level of printing ink in an ink fountain, including, by the use of an ink metering device, topping off printing ink along an ink fountain roller that dips into the printing ink; by a level sensor, determining signals relating to the actual level along the ink fountain roller, feeding the signals relating to the actual level to a control device; in the control device, comparing the signals fed thereto with signals relating to a desired level; forming actuating signals from the derived comparative signals, for an actuating element in the ink metering device, so that printing ink is topped off along the ink fountain roller in accordance with ink acceptance from the ink fountain; from a container with a limited supply of printing ink, dispensing the printing ink for topping off and, if necessary or desirable, renewing the supply of ink in accordance with ink demand, which further includes, for each measurement location of the level sensor, determining the change in the actual level per unit time, continuously determining the residual amount of printing ink in the container and, whenever the residual amount of printing ink falls below a specific value, removing the residual amount of printing ink from the container and feeding it into the ink fountain in a manner proportional to the change in level per unit time at the respective discharge location.

9 Claims, 2 Drawing Sheets

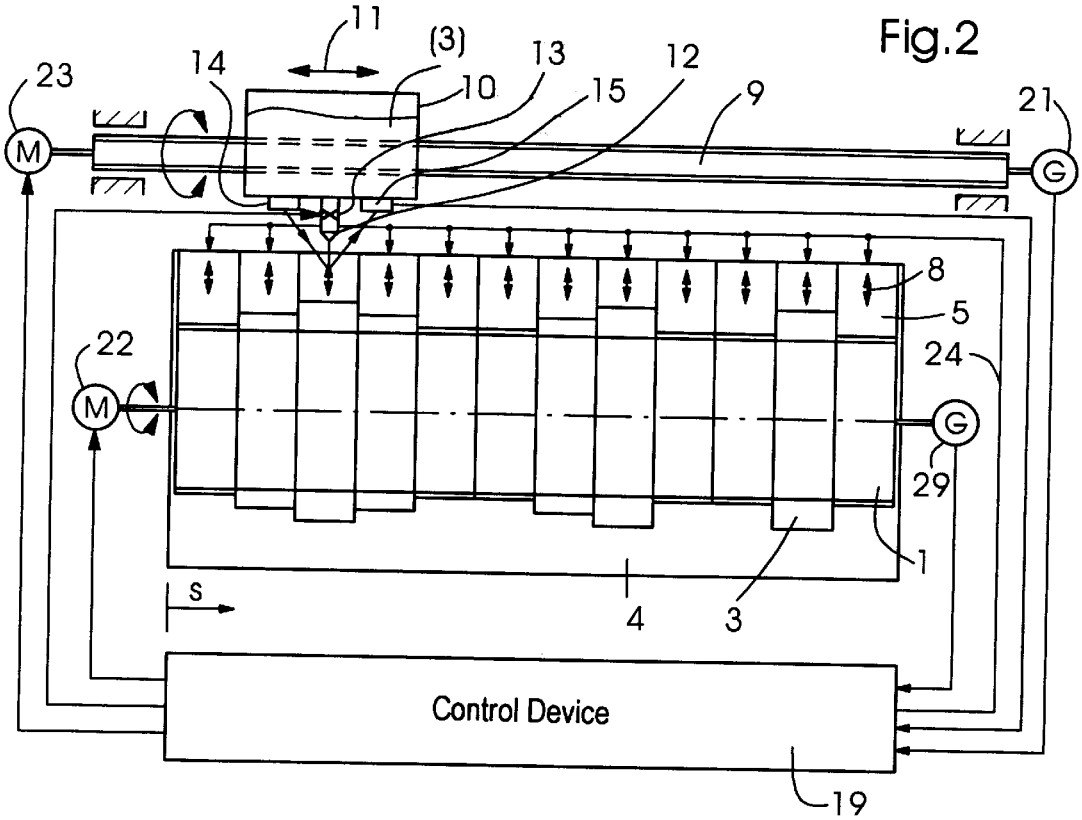
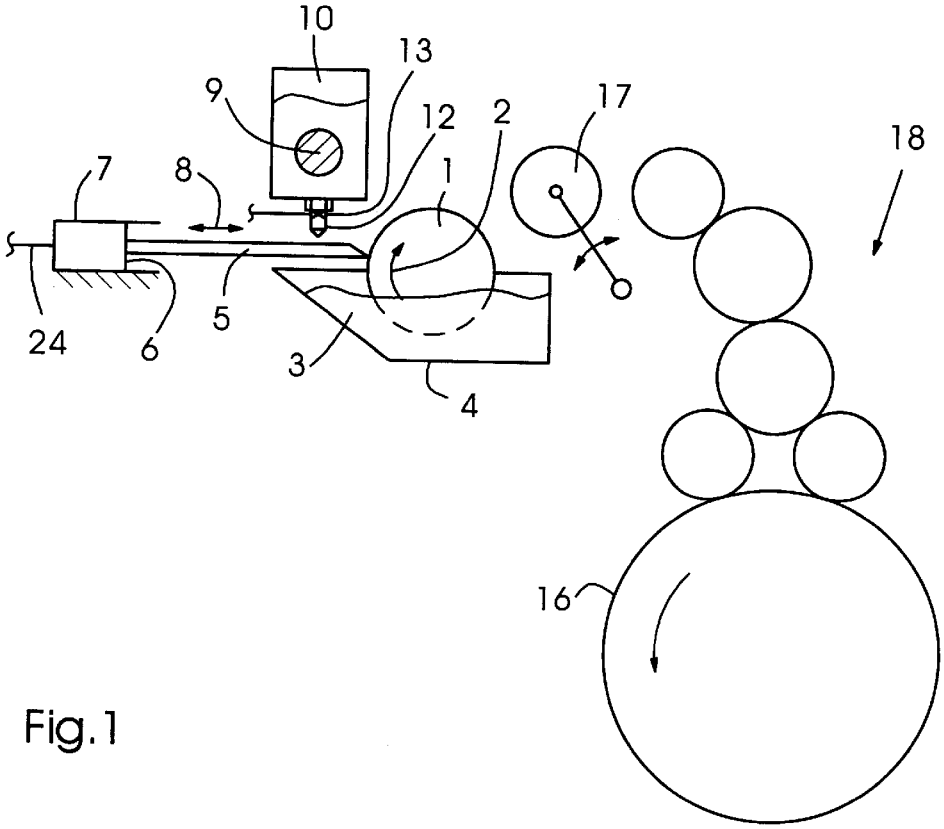
Fig.1

METHOD OF CONTROLLING THE LEVEL OF PRINTING INK IN AN INK FOUNTAIN AND FOR EMPTYING AN INK CARTRIDGE HAVING LESS THAN A SPECIFIED AMOUNT OF INK THEREIN

BACKGROUND OF THE INVENTION

Field of the Invention

The invention relates to a method of controlling the level of printing ink in an ink fountain.

In printing machines, it has been known heretofore to top off the used printing ink in an ink fountain from a cartridge (published German Patent Document DE 196 36 985 D1). Because of the viscosity of the printing ink, the printing ink is discharged from the cartridge so that it is metered uniformly along an ink fountain roller that dips into the printing ink. The level of the printing ink in the ink fountain can be regulated by determining or registering the actual level continuously with the aid of a level sensor, by comparing the actual level with a desired or nominal level value and by deriving from the obtained comparative values, actuating signals for an actuating element of a pushing or expulsion device for the cartridge. The actuating signals effect the closest possible match between the actual state and the desired or nominal state.

It has also been known to register or determine the ink supply volume in the cartridge by suitable sensors and to generate a signal which indicates that the volume of ink supply is coming to an end. An operator of a printing machine that is operating continuously is thus given an opportunity to replace a used or depleted cartridge with a full cartridge. Any residue of printing ink in the used cartridge can be expelled beforehand into the ink fountain manually or by machine.

Heretofore known methods of topping off printing ink in an ink fountain have the disadvantage that, as a result of controlling the filling level to the most uniform level possible, the time which is available for changing a cartridge or a similar supply container is reduced. There is a risk that, in particular in the case of multicolor printing machines having a large number of printing units, changing a cartridge is not possible, because the operator is already busy with other operating procedures or cartridge changes. In such a case, the printing operation has to be interrupted and started up again, which reduces productivity. Topping off to a uniform level also has the disadvantage that, at the end of the print job, the respective level remains in the ink fountains. If a print job follows wherein printing is to be performed with other colors, the printing ink from the previous job has to be removed, a task that is complicated and gives rise to costs because, as a rule, these printing inks have to be removed inasmuch as they cannot be reused. A like disadvantage occurs when the printing machine is to be stopped, for example at the end of a shift, and the printing ink has to be removed from the ink fountains.

SUMMARY OF THE INVENTION

It is accordingly an object of the invention to provide a method of controlling a level of printing ink in an ink fountain which permits a reduction in the consumption of printing ink and an improvement in the reliability or dependability of the supply of ink in a printing machine.

With the foregoing and other objects in view, there is provided, in accordance with the invention, a method of controlling a level of printing ink in an ink fountain, including, by the use of an ink metering device, topping off printing ink along an ink fountain roller that dips into the printing ink; by a level sensor, determining signals relating to the actual level along the ink fountain roller, feeding the signals relating to the actual level to a control device; in the control device, comparing the signals fed thereto with signals relating to a desired level; forming actuating signals from the derived comparative signals, for an actuating element in the ink metering device, so that printing ink is topped off along the ink fountain roller in accordance with ink acceptance from the ink fountain; from a container with a limited supply of printing ink, dispensing the printing ink for topping off and, if necessary or desirable, renewing the supply of ink in accordance with ink demand, which comprises, for each measurement location of the level sensor, determining the change in the actual level per unit time, continuously determining the residual amount of printing ink in the container and, whenever the residual amount of printing ink falls below a specific value, removing the residual amount of printing ink from the container and feeding it into the ink fountain in a manner proportional to the change in level per unit time at the respective discharge location.

In accordance with another mode, the method invention includes substantially at the same time that the residual amount is being removed, generating a signal for designating a necessity for renewing the supply in the container.

In accordance with a further mode, when the container is a tubular cartridge, the method invention includes positioning the tubular cartridge so that it extends in the direction of the axis of rotation of the ink fountain roller for performing the metered discharge of printing ink.

In accordance with an added mode, the method invention includes moving the cartridge to a discharge location with a frequency correlated with the change in the level of printing ink per unit time.

In accordance with an additional mode, the method invention includes positioning the cartridge at discharge locations lying in the center of a respective zone of a plurality of zones predefined by ink knives set close to the ink fountain roller or metering elements acting in a similar manner.

In accordance with yet another mode, the method invention includes positioning the cartridge only at discharge locations at which the magnitude of the change in level per unit time is a maximum.

In accordance with yet a further mode, the method invention includes renewing the ink supply by replacing a used cartridge with a fresh cartridge.

In accordance with yet an added mode, the method invention includes, when producing a prescribed number of prints, for a last time removing from the container an amount of printing ink that is just sufficient, when a final print is made, to leave a remainder of ink in the ink fountain that is a minimum amount required for the final print.

In accordance with yet a concomitant mode, the method includes, when the printing ink is being discharged at discrete discharge locations, taking into account the flow behavior of the printing ink in the direction of adjacent discharge locations in calculating the amount to be discharged.

As noted hereinbefore, the method may be performed with an ink metering device wherein a cartridge or an equivalent container for printing ink is moved along an ink fountain roller that dips into the printing ink. Likewise, it is possible to use a number of ink metering devices, respectively, covering subareas along the length of the ink fountain roller. In the method invention, the local rate of change of the ink level in the ink fountain is taken into account, whereby a lengthening of the time that is available for changing the cartridge or the container occurs. In the case of multicolor printing machines, for the purpose of optimizing the time for the changing, the actual value signals relating to the level from all the ink fountains are processed, it being possible to take into account the times for an operator to move between the printing units and the control desk therefor. The residual amount of printing ink remaining in the ink fountain after a job has been finished is minimal, and the level thereof is only as high as is required to maintain a hydrostatic pressure between the ink fountain roller and the metering elements which are set close to the latter.

Other features which are considered as characteristic for the invention are set forth in the appended claims.

Although the invention is illustrated and described herein as a method of controlling the level of printing ink in an ink fountain, it is nevertheless not intended to be limited to the details shown, since various modifications and changes may be made therein without departing from the spirit of the invention and within the scope and range of equivalents of the claims.

The method of operation of the invention, however, together with additional objects and advantages thereof will be best understood from the following description of specific modes of the method when read in connection with the accompanying drawings, wherein:

BRIEF DESCRIPTION OF THE DRAWINGS

FIG. 1 is a diagrammatic side elevational view of a printing unit of a printing machine;

FIG. 2 is a diagrammatic and schematic front elevational view of the printing unit of the printing machine, particularly showing the outer surface of an ink fountain roller;

DESCRIPTION OF THE PREFERRED EMBODIMENTS

Figure 3:
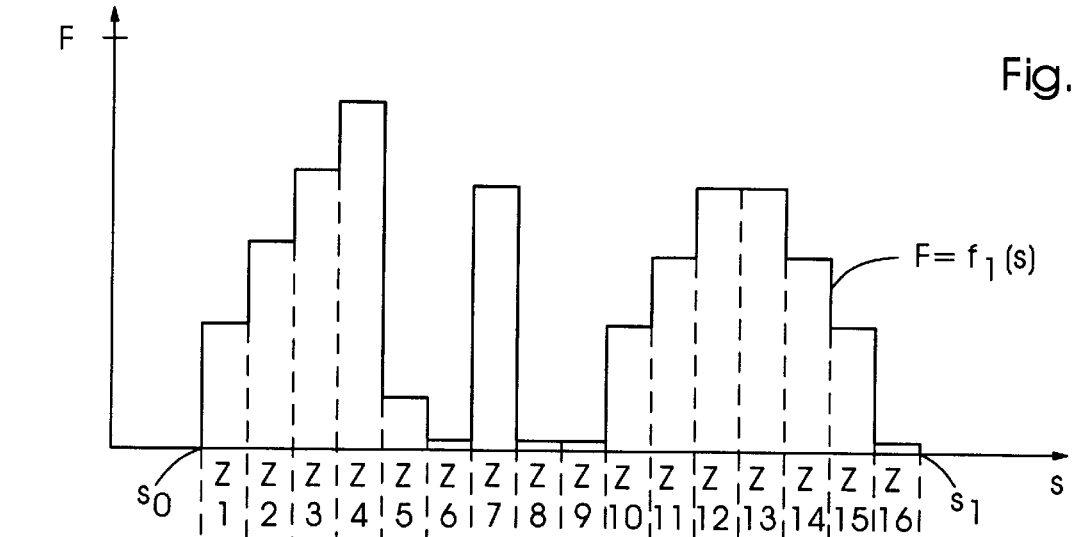
FIG. 3 is a plot diagram or graph of the ink acceptance along an ink fountain roller.

Referring now to the drawing and, first, particularly to FIGS. 1 and 2 thereof, there is shown therein a printing unit 1 that is suitable for performing the method invention. An ink fountain roller 1 is mounted so that it can rotate in the direction of the curved arrow 2 and dip partly into printing ink 3 provided in an ink fountain 4. Along a generatrix of the outer cylindrical surface of the ink fountain roller 1, ink knives 5 of like or equal width are set close to the ink fountain roll 1, without any gaps therebetween. Each of the ink knives 5 is coupled with a respective piston 6 of an actuating cylinder 7 shown in FIG. 1 but omitted from FIG. 2 in the interest of clarity. The ink knives 5 are positionable in the radial direction 8 of the ink fountain roller 1 due to the movement of the piston 6. Provided parallel to the axis of rotation of the ink fountain roller 1 is a rotatably mounted threaded spindle 9, whereon a movable container 10 for printing ink 3 is seated. When the threaded spindle 9 is rotated, the container 10 moves in a lateral direction represented by the double-headed arrow 11. The container 10 has an outlet 12 with an outlet valve 13. The outlet opening of the outlet 12 is directed towards the ink fountain 4 that is open at the top thereof. Located on the container 10 are a transmitter 14 and a receiver 15 of a distance measuring system for registering or determining the level of the printing ink 3 in the ink fountain 4, respectively, at the location at which printing ink 3 is topped off. In order to transfer printing ink 3 from the ink fountain roller 1 to the surface of a printing plate cylinder 16, a reciprocating vibratory roller 17 and a series of ink transfer rollers 18 are provided. For the purpose of receiving signals, a control device 19 is connected to rotary encoders 29 and 21, respectively, for the rotational angle of the ink fountain roller 1 and the threaded spindle 9, and is also connected to the receiver 15. In order to output actuating signals, the control device 19 is connected to motors 22 and 23, for driving the ink fountain roller 1 and the threaded spindle 9, respectively, to an actuating element for the outlet valve 13 and, via pressure-medium lines 24, to the actuating cylinders 7, only one of which is shown in FIG. 1.

Figure 4:
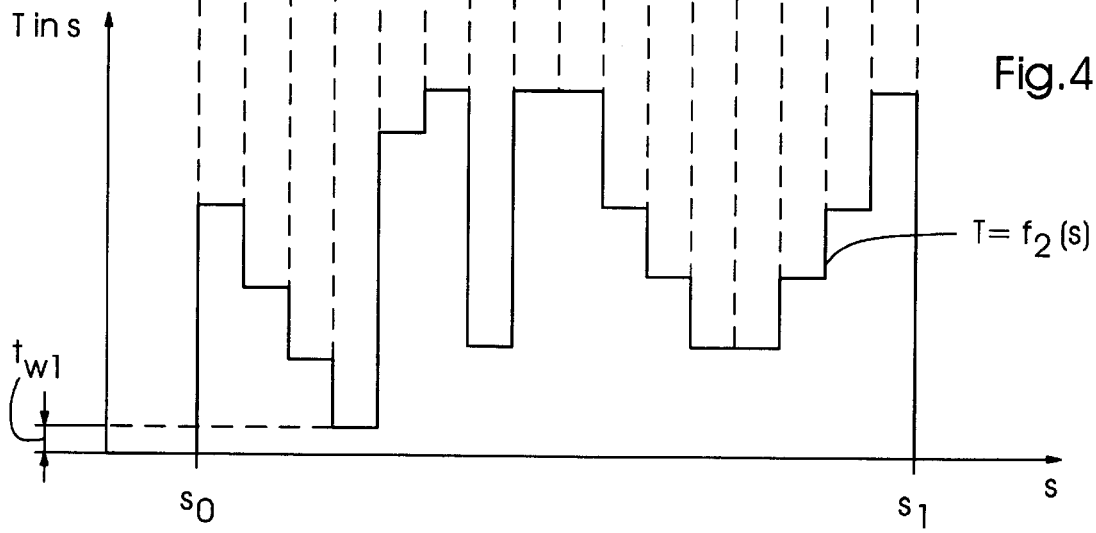
FIG. 4 is a graph with zonal time limits for a cartridge change according to the prior art.
Figure 5:
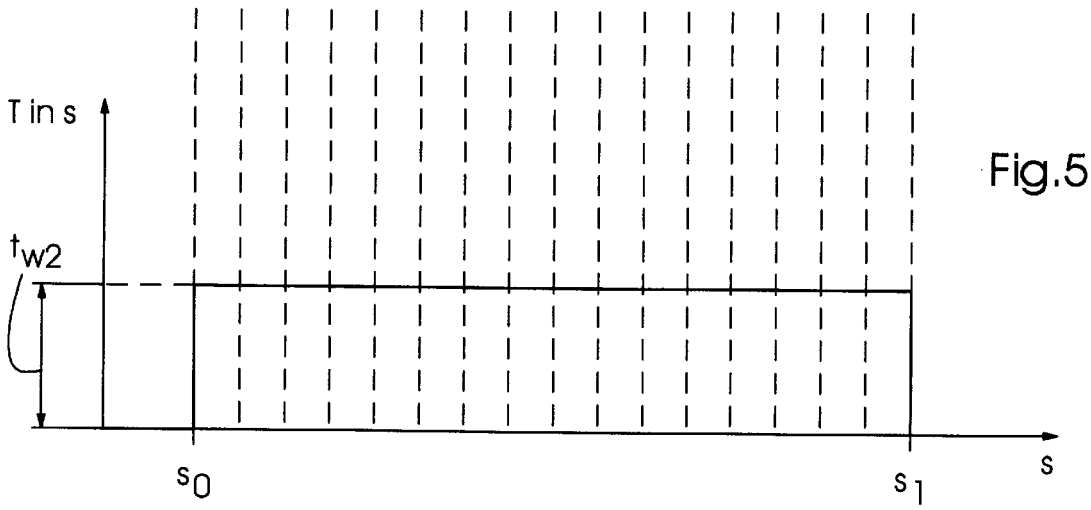
FIG. 5 is a graph with zonal time limits for a cartridge change according to the method invention of the instant application.

With reference to FIGS. 3 to 5, hereinafter described is how the method invention can be performed with the arrangement disclosed in FIGS. 1 and 2. When printing is being performed with a printing machine, the ink knives 5 are adjusted in the radial direction 8 so that an ink profile corresponding to the zonal ink demand on a printing material is formed on the surface of the ink fountain roller 1. If there is a large gap between the ink knives 5 and the ink fountain roller 1, a high layer thickness of printing ink 3 is formed on the surface of the ink fountain roller 1. By ink splitting processes, a correspondingly large amount of ink is transferred to the respective printing material via the vibratory roller 17, the ink transfer roller 18 and the printing plate cylinder 16.

For an inking unit F having 16 ink knives 5, there is illustrated in FIG. 3 an example of the level of the ink consumption per unit time in the 16 inking zones Z1 to Z16. FIG. 4 shows how long it would be possible to print at a uniform printing speed if, in the case of the ink consumption F shown in FIG. 3, a constant level of printing ink 3 in the ink fountain 4 is assumed. It is apparent that, in the zone Z4 having the highest ink consumption per unit time, the ink supply is used up most rapidly. The consumption in zone Z4 determines the time to renew the supply of printing ink in the container 10. The time interval tw1 identified in FIG. 4 is the amount of time available to change the container 10.

At the beginning of a print job, the ink fountain 4 is filled in accordance with the ink acceptances to be expected in the zones Z1 to Z16. The zone opening values of the ink knives 5 for each zone Z1 to Z16, and the value of the intended printing speed are provided in the control device 19. From these data, a filling level profile of the printing ink 3 in the ink fountain 4 is calculated in the control device 19, an appropriate safety margin being taken into account. Using the motor 23, the rotary encoder 21 and the threaded spindle 9, the container 10 is positioned in the lateral direction represented by the double-headed arrow 11, in each case to the center of a respective inking zone Z1 to Z16. At each discharge location, the control device 19 causes the outlet valve 13 to open, so that for each zone Z1 to Z16, the precalculated amount of printing ink 3 passes out of the outlet 12 into the ink fountain 4. After the processing of the print job has been started, the level of printing ink 3 in the ink fountain 4 is initially controlled in such a manner that the filling level profile selected at the start is maintained. Before each discharge of printing ink 3 at a discharge location, the actual level in the relevant zone Z1 to Z16 is determined with the aid of the transmitter 14 and the receiver 15, and is forwarded to the control device 19. In the control device 19, the real ink acceptance per unit time in the relevant zone Z1 to Z16 is calculated from the current actual level, from the value relating to the actual level of the preceding measurements and from the time interval between the current and the preceding measurement. The amount to be discharged in the zone Z1 to Z16 is adjusted from the real ink acceptance per unit time.

FIGS. 3 and 4 are very schematic graphs or plot diagrams. Because of the flow properties of the printing ink 3, a balancing or equalization in the filling of adjacent zones Z1 to Z16 results. During the metering of the printing ink 3, in the course of the first filling and during filling in the course of processing the print job, the time-dependent and level-dependent flow processes of the printing ink 3 among the zones Z1 to Z16 can be taken into account. For this purpose, the viscosity and/or the temperature of the printing ink 3 may be determined or registered continuously.

Likewise, it is possible to take into account the charging frequency and the stroke of an ink transfer roller 18 that is formed as a distributor roller and which likewise has the effect of interchanging the quantity of ink among the zones Z1 to Z16.

FIG. 5 illustrates, as in FIG. 4, the range over time of the printing ink in the zones Z1 to Z16 which results if the filling level is controlled in accordance with the rate of acceptance of the printing ink 3. The time $t_{w2}$ available for changing or topping off the container 10 is constant in all the zones Z1 to Z16 and is given by $$t_{w2} = \frac{\int_{s_0}^{s_1} f_2(s)}{s_1 - s_0}$$

The time that is available is increased by the value $(t_{w2}-t_{w1})$.

If the ink supply in the container 10 approaches the end, the residual amount of printing ink 3 is discharged, taking into account the real ink acceptance. If a cartridge is used as the container 10, the residue is pressed out. This increases the time that is available for changing the container by a further amount. The residual amount of ink in the container 10 is given by a direct measurement or indirectly by a measurement of the amount metered by the outlet valve.

When the print job approaches the end, the level in the ink fountain 4 is reduced in all the zones Z1 to Z16 to such an extent that, at the end of the print job, the ink fountain 4 has been emptied down to the minimum amount of printing ink 3 that is necessary to maintain the hydrostatic pressure. When calculating the reduction, use is made of the values for the ink consumption per printing and per zone Z1 to Z16, which can be determined during the entire print job from the actual level values and the amounts metered per zone Z1 to Z16. The residual amount of printing ink that remains in the ink fountain 4 after printing has been finished can be removed automatically by a cleaning device for the ink fountain 4.

We claim:

1. A method of controlling a level of printing ink in an ink fountain, including, by the use of an ink metering device, topping off printing ink along an ink fountain roller that dips into the printing ink; by a level sensor, determining signals relating to the actual level along the ink fountain roller, feeding the signals relating to the actual level to a control device; in the control device, comparing the signals fed thereto with signals relating to a desired level; forming actuating signals from the derived comparative signals, for an actuating element in the ink metering device, so that printing ink is topped off along the ink fountain roller in accordance with ink acceptance from the ink fountain; from a container with a limited supply of printing ink, dispensing the printing ink for topping off and, if one of necessary and desirable, renewing the supply of ink in accordance with ink demand, which comprises, for each measurement location of the level sensor, determining the change in the actual level per unit time, continuously determining the residual amount of printing ink in the container and, whenever the residual amount of printing ink falls below a specific value, removing the residual amount of printing ink from the container and feeding it into the ink fountain in a manner proportional to the change in level per unit time at the respective discharge location.

2. The method according to claim 1, which includes substantially at the same time that the residual amount is being removed, generating a signal for designating a necessity for renewing the supply in the container.

3. The method according to claim 1, wherein the container is a tubular cartridge, and which includes positioning the tubular cartridge so that it extends in the direction of the axis of rotation of the ink fountain roller for performing the metered discharge of printing ink.

4. The method according to claim 3, which includes moving the cartridge to a discharge location with a frequency correlated with the change in the level of printing ink per unit time.

5. The method according to claim 3, which includes positioning the cartridge at discharge locations lying in the center of a respective zone of a plurality of zones predefined by one of an assembly of ink knives set close to the ink fountain roller and an assembly of metering elements acting in a similar manner.

6. The method according to claim 3, which includes positioning the cartridge only at discharge locations at which the magnitude of the change in level per unit time is a maximum.

7. The method according to claim 3, which includes renewing the ink supply by replacing a used cartridge with a fresh cartridge.

8. The method according to claim 1, which includes, when producing a prescribed number of prints, for a last time removing from the container an amount of printing ink that is just sufficient, when a final print is made, to leave a remainder of ink in the ink fountain that is a minimum amount required for the final print.

9. The method according to claim 1, which includes, when the printing ink is being discharged at discrete discharge locations, taking into account the flow behavior of the printing ink in the direction of adjacent discharge locations in calculating the amount to be discharged.

* * * * *